US011514852B2

(12) United States Patent
Wang et al.

(10) Patent No.: US 11,514,852 B2
(45) Date of Patent: Nov. 29, 2022

(54) PIXEL ARRAY

(71) Applicant: Au Optronics Corporation, Hsinchu (TW)

(72) Inventors: Ya-Jung Wang, Hsinchu (TW); Jing-Wun Jhang, Hsinchu (TW); Rong-Fu Lin, Hsinchu (TW); Nien-Chen Li, Hsinchu (TW); Hsien-Chun Wang, Hsinchu (TW); Che-Chia Chang, Hsinchu (TW); June Woo Lee, Hsinchu (TW); Hsin-Ying Lin, Hsinchu (TW); Chia-Ting Hsieh, Hsinchu (TW); Chien-Fu Huang, Hsinchu (TW); Sung-Yu Su, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 17/724,495

(22) Filed: Apr. 20, 2022

(65) Prior Publication Data

US 2022/0335887 A1 Oct. 20, 2022

Related U.S. Application Data

(60) Provisional application No. 63/177,345, filed on Apr. 20, 2021.

(30) Foreign Application Priority Data

Mar. 22, 2022 (TW) ..... 111110664

(51) Int. Cl.
*G09G 3/32* (2016.01)

(52) U.S. Cl.
CPC ..... *G09G 3/32* (2013.01); *G09G 2300/0452* (2013.01); *G09G 2300/0819* (2013.01); (Continued)

(58) Field of Classification Search
CPC ..... G09G 3/32; G09G 2300/0452; G09G 2300/0819; G09G 2300/0861; G09G 2320/0233
See application file for complete search history.

(56) References Cited

U.S. PATENT DOCUMENTS 9,564,083 B2 * 2/2017 Bae ..... G09G 3/3266
9,607,546 B2 * 3/2017 Kim ..... G09G 3/3233
(Continued)

FOREIGN PATENT DOCUMENTS

| | | |
|---|---|---|
| CN | 106409233 | 2/2017 |
| CN | 106997747 | 8/2017 |
| CN | 111462684 | 7/2020 |

*Primary Examiner* — Gene W Lee
(74) *Attorney, Agent, or Firm* — JCIPRNET

(57) ABSTRACT

A pixel array is provided. The pixel array includes a plurality of red pixels, a plurality of green pixels, and a plurality of blue pixels. Each green pixel includes a light emitting diode (LED), a first transistor, a second transistor, a third transistor, and a fourth transistor. The LED receives a system low voltage. The first transistor receives a first data signal and a first scan signal. The second transistor is coupled to a second end of the first transistor and the anode of the light emitting diode. The third transistor receives a system high voltage and a first control signal, and is coupled to a first end of the second transistor. The fourth transistor is coupled to the anode of the light-emitting diode of an adjacent green pixel, a control terminal of the third transistor, and the anode of the light-emitting diode.

11 Claims, 7 Drawing Sheets

(52) U.S. Cl.
CPC ..... *G09G 2300/0861* (2013.01); *G09G 2320/0233* (2013.01)

(56) References Cited

U.S. PATENT DOCUMENTS

| | | | | |
|---|---|---|---|---|
| 10,297,197 | B2 * | 5/2019 | Chung | G09G 3/3233 |
| 10,854,698 | B2 * | 12/2020 | So | G09G 3/3233 |
| 10,891,896 | B2 * | 1/2021 | Wu | G09G 3/3266 |
| 10,950,173 | B2 | 3/2021 | Zheng | |
| 2021/0134892 | A1 * | 5/2021 | Hwang | H01L 27/3276 |
| 2022/0084464 | A1 * | 3/2022 | Lee | G09G 3/3208 |

* cited by examiner

PIXEL ARRAY

CROSS-REFERENCE TO RELATED APPLICATION

This application claims the priority benefit of U.S. provisional application Ser. No. 63/177,345, filed on Apr. 20, 2021 and Taiwan application serial no. 111110664, filed on Mar. 22, 2022. The entirety of each of the above-mentioned patent applications is hereby incorporated by reference herein and made a part of this specification.

BACKGROUND

Technical Field

The disclosure relates to a pixel array, and in particular, to a light-emitting diode pixel array.

Description of Related Art

Due to a growing awareness of environmental protection, energy saving, service life, color saturation, and power quality have gradually become the concerns of consumers when they are making a purchase. At the same time, light-emitting diode (LED) chips rapidly advance and the cost thereof is decreasing, so the light-emitting diodes have become a mainstream of the lighting and display market in the future.

The LEDs of different colors require different materials, which means that the light-emitting efficiency curves of the LEDs of different colors may be different. Therefore, to enhance the light-emitting efficiency of an LED panel, it may be necessary to adjust a pixel circuit based on the light-emitting efficiency of the LED.

SUMMARY

The disclosure provides a pixel array capable of causing light-emitting efficiency of a green light-emitting diode to approach the greatest light-emitting efficiency, thereby enhancing the light-emitting efficiency of a green pixel circuit.

A pixel array of the disclosure includes multiple red pixels, multiple green pixels, and multiple blue pixels. The green pixels are arranged along a first direction to form multiple green pixel lines. Each of the green pixels includes a light-emitting diode, a first transistor, a second transistor, a third transistor, and a fourth transistor. The light-emitting diode has an anode and a cathode receiving a system low voltage. The first transistor has a first end receiving a first data signal, a control terminal receiving a first scan signal, and a second end. The second transistor has a first end, a control terminal coupled to the second end of the first transistor, and a second end coupled to the anode of the light-emitting diode. The third transistor has a first end receiving a system high voltage, a control terminal receiving a first control signal, and a second end coupled to the first end of the second transistor. The fourth transistor has a first end coupled to the anode of the light-emitting diode of an adjacent green pixel, a control terminal coupled to the control terminal of the third transistor, and a second end coupled to the anode of the light-emitting diode.

Based on the above, in the pixel array of the embodiment of the disclosure, the second transistor, the third transistor, and the fourth transistor are turned on and connected in parallel to the green light-emitting diodes of the green pixels of a current stage and a previous stage, thereby reducing a current passing through each of the green light-emitting diodes. In this way, the light-emitting efficiency of the green light-emitting diodes may approach the greatest light-emitting efficiency.

In order to make the aforementioned features and advantages of the disclosure comprehensible, embodiments accompanied with drawings are described in detail below.

DESCRIPTION OF THE EMBODIMENTS

Unless otherwise defined, all terms (including technical and scientific terms) used herein have the same meaning as commonly understood by those of ordinary skill in the art to which the disclosure belongs. It will be further understood that terms such as those defined in commonly used dictionaries shall be construed to have a meaning consistent with their meaning in the context of the relevant art and the disclosure and will not be construed to have an idealized or overly formal meaning unless expressly defined as such herein.

It should be noted that although the terms "first", "second", "third", etc. may be used for describing various elements, components, regions, layers and/or portions, the elements, components, regions, layers and/or portions are not limited by these terms. These terms are only used for separating one element, component, region, layer or portion from another element, component, region, layer or portion. Therefore, the following discussed "first element", "component", "region", "layer" or "portion" may be referred to as a second element, component, region, layer or portion without departing from the scope of the invention.

The terminology used herein is for the purpose of describing particular embodiments and is not intended to be limiting of the invention. As used herein, the singular forms "a," "an" and "the" are intended to include the plural forms as well, unless the context clearly indicates otherwise. "Or" represents "and/or". The term "and/or" used herein includes any or a combination of one or more of the associated listed items. It will be further understood that the terms "comprises," "comprising," "includes" and/or "including," when used herein, specify the presence of stated features, regions, integers, steps, operations, elements, and/or components, but do not preclude the presence or addition of one or more other features, regions, integers, steps, operations, elements, components, and/or groups thereof.

Figure 1:
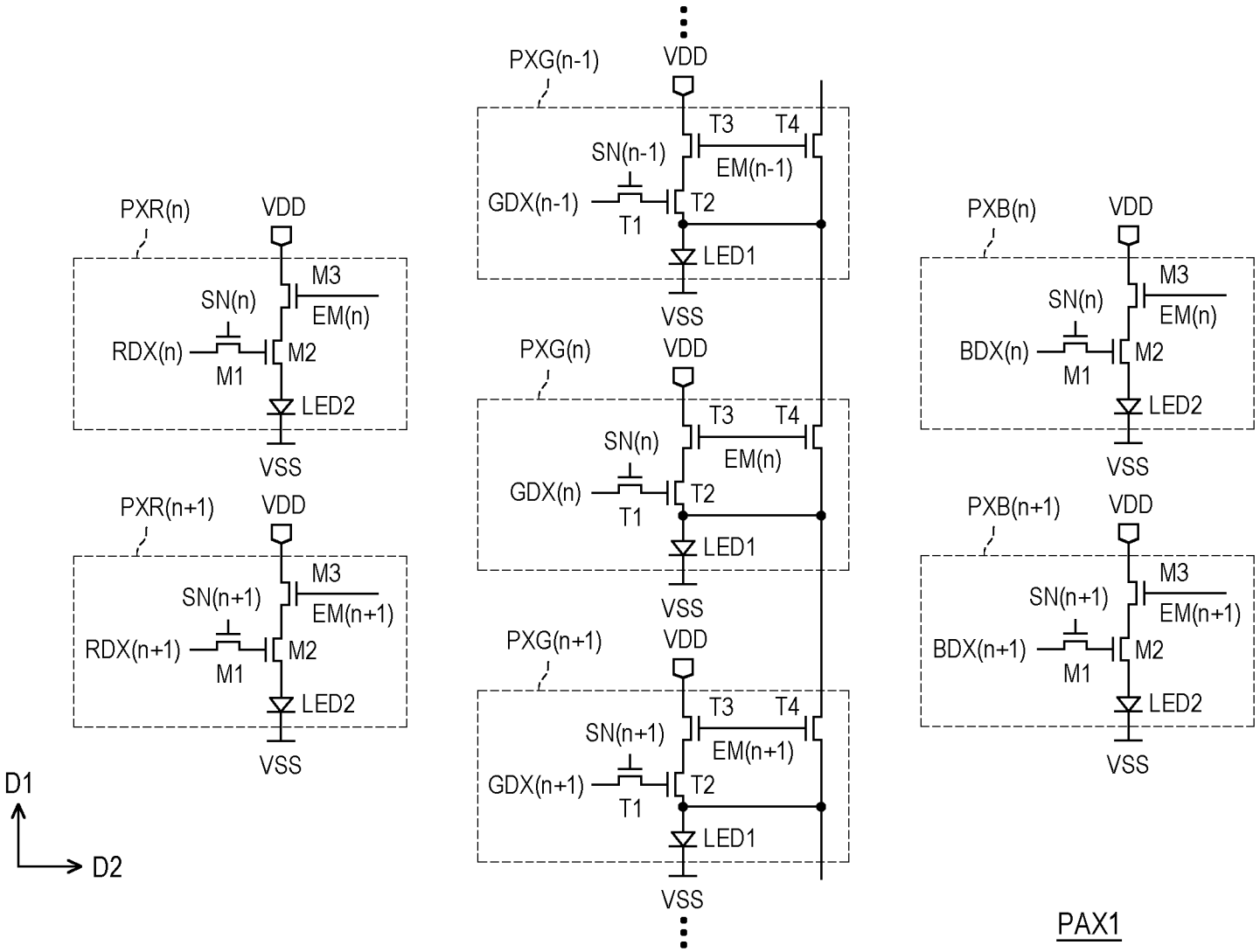
FIG. 1 is a schematic diagram of a circuit of a pixel array according to a first embodiment of the disclosure.

FIG. 1 is a schematic diagram of a circuit of a pixel array according to a first embodiment of the disclosure. Referring to FIG. 1, in the embodiment, a pixel array PAX1 includes multiple red pixels (e.g. PXR(n) to PXR(n+1)), multiple green pixels (e.g. PXG(n−1) to PXG(n+1)), and multiple blue pixels (e.g. PXB(n) to PXB(n+1)). The red pixels PXR(n) to PXR(n+1), the green pixels PXG(n−1) to PXG (n+1), and the blue pixels PXB(n) to PXB(n+1) are driven, for example, through an impulse driving mode, and n is an index number.

In the embodiment, the red pixels (e.g. PXR(n) to PXR (n+1)) are arranged along a first direction D1 (e.g. a vertical direction of the drawings) to form multiple red pixel lines. The green pixels (e.g. PXG(n−1) to PXG(n+1)) are arranged along the first direction D1 to form multiple green pixel lines. The blue pixels (e.g. PXB(n) to PXB(n+1)) are arranged along the first direction D1 to form multiple blue pixel lines. The red pixel lines, the green pixel lines, and the blue pixel lines may be alternately disposed along a second direction D2 perpendicular to the first direction D1.

In the embodiment, each of the green pixels (e.g. PXG (n−1) to PXG(n+1)) includes a light-emitting diode LED1 (here, it is a green light-emitting diode), a first transistor T1, a second transistor T2, a third transistor T3, and a fourth transistor T4. The light-emitting diode LED1 has an anode and a cathode receiving a system low voltage VSS. The first transistor T1 has a first end receiving a first data signal (e.g. green data signals GDX(n−1) to GDX(n+1)), a control terminal receiving a first scan signal (e.g. SN(n−1) to SN(n+1)), and a second end. The second transistor T2 has a first end, a control terminal coupled to the second end of the first transistor T1, and a second end coupled to the anode of the light-emitting diode LED1.

The third transistor T3 has a first end receiving a system high voltage VDD, a control terminal receiving a first control signal (e.g. light-emitting signals EM(n−1) to EM(n+1)), and a second end coupled to the first end of the second transistor T2. The fourth transistor T4 has a first end coupled to the anode of the light-emitting diode LED1 of a vertically adjacent green pixel (e.g. PXG(n−1) to PXG(n+1)), a control terminal coupled to the control terminal of the third transistor T3, and a second end coupled to the anode of the light-emitting diode LED1.

Specifically, taking the green pixel PXG(n) as an example, the first end of the first transistor T1 receives the green data signal GDX(n), and the control terminal of the first transistor T1 receives the scan signal SN(n). In addition, the control terminal of the third transistor T3 receives the light-emitting signal EM(n).

Figure 2:
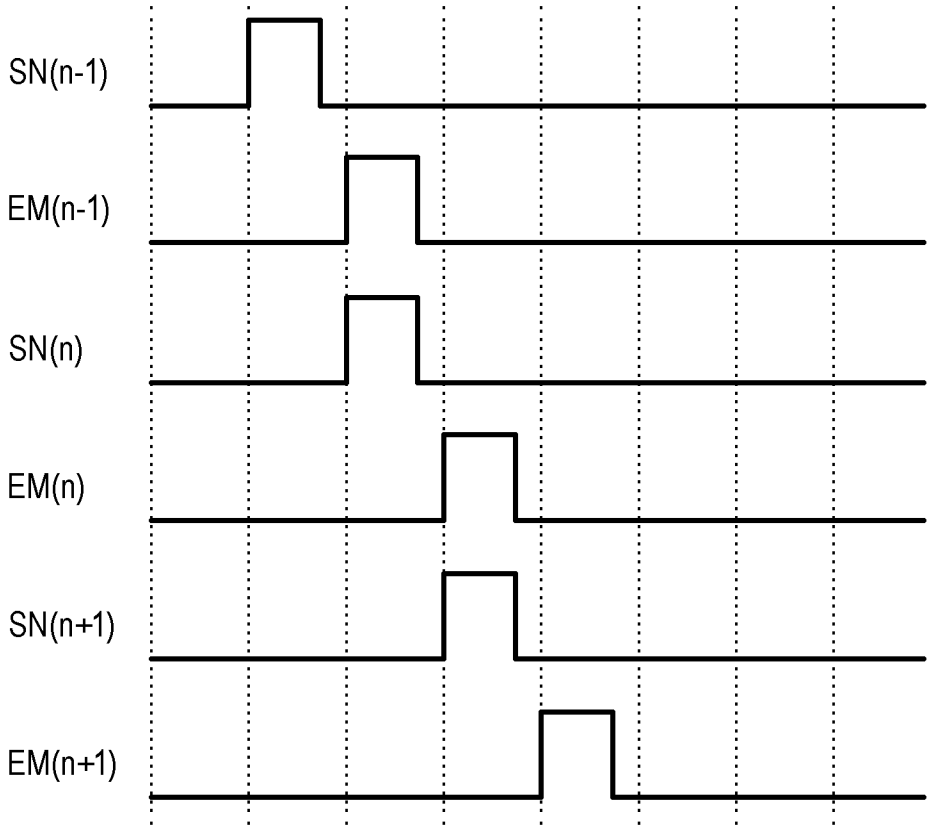
FIG. 2 is a schematic diagram of a driving waveform of a pixel array according to a first embodiment of the disclosure.

FIG. 2 is a schematic diagram of a driving waveform of a pixel array according to a first embodiment of the disclosure. Referring to FIG. 1 and FIG. 2, as shown in FIG. 2, the scan signals SN(n−1) to SN(n+1) are sequentially enabled based on the time. That is, enabled level periods of the scan signals SN(n−1) to SN(n+1) are sequentially formed based on the time. In addition, similarly, the light-emitting signals EM(n−1) to EM(n+1) are sequentially enabled based on the time. That is, similarly, enabled level periods of the light-emitting signals EM(n−1) to EM(n+1) are sequentially formed based on the time. For the green pixel PXG(n), the enabled level period of the light-emitting signal EM(n) is later than the enabled level period of the scan signal SN(n).

For example, in a case where the green pixel PXG(n) is driven, when the scan signal SN(n) is enabled, the green data signal GDX(n) performs writing. Next, when the light-emitting signal EM(n) is enabled, the third transistor T3 and the fourth transistor T4 of the green pixel PXG(n) are turned on, and a conductivity degree of the second transistor T2 of the green pixel PXG(n) reflects a voltage level of the green data signal GDX(n). At this time, starting from the system high voltage VDD, a current passes through the second transistor T2, the third transistor T3, and the light-emitting diode LED1 of the green pixel PXG(n) and flows to the system low voltage VSS. In addition, the current also passes through the second transistor T2, the third transistor T3, and the fourth transistor T4 of the green pixel PXG(n) and the light-emitting diode LED1 of the pixel PXG(n−1) and flows to the system low voltage VSS.

In other words, the second transistor T2, the third transistor T3, and the fourth transistor T4 that are turned on are connected in parallel to the two light-emitting diodes LED1 of the green pixels PXG(n) and PXG(n−1). In the embodiment of the disclosure, when a greater current passes through a red light-emitting diode and a blue light-emitting diode, there is greater light-emitting efficiency. However, the same does not apply to the green light-emitting diode. The green light-emitting diode only exhibits the greatest light-emitting efficiency at a specific current, and as the current increases, the light-emitting efficiency decreases. Hence, with the two light-emitting diodes LED1 of the two green pixels (e.g. PXG(n−1) to PXG(n+1)) connected in parallel, a current passing through each of the green light-emitting diodes may be reduced so that the light-emitting efficiency of the green light-emitting diodes may approach the greatest light-emitting efficiency.

Referring to FIG. 1, in the embodiment, each of the red pixels (e.g. PXR(n) to PXR(n+1)) and each of the blue pixels (e.g. PXB(n) to PXB(n+1)) include a light-emitting diode LED2 (here, it is a red light-emitting diode or a blue light-emitting diode) and transistors M1 to M3. A cathode of the light-emitting diode LED2 receives the system low voltage VSS. The transistor M1 has a first end receiving a data signal (e.g. red data signals RDX(n) to RDX(n+1) and blue data signals BDX(n) to BDX(n+1)), a control terminal receiving a scan signal (e.g. SN(n) to SN(n+1)), and a second end. The transistor M2 has a first end, a control terminal coupled to the second end of the transistor M1, and a second end coupled to an anode of the light-emitting diode LED2. The transistor M3 has a first end receiving the system high voltage VDD, a control terminal receiving the light-emitting signal (e.g. EM(n) to EM(n+1)), and a second end coupled to the first end of the transistor M2.

Figure 3:
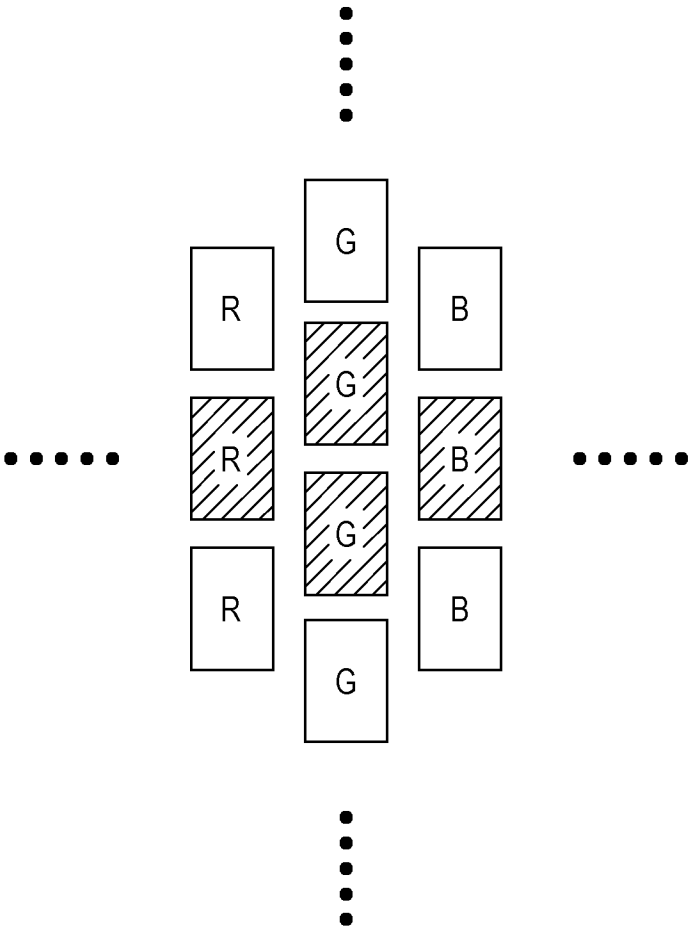
FIG. 3 is a schematic diagram of a display of a pixel array according to a first embodiment of the disclosure.

FIG. 3 is a schematic diagram of a display of a pixel array according to a first embodiment of the disclosure. Referring to FIG. 1 to FIG. 3, in the embodiment, the red pixels (e.g. PXR(n) to PXR(n+1)) and the blue pixels (e.g. PXB(n) to PXB(n+1)) are illuminated one by one (as shown by R and B with hatching lines). However, the green pixels (e.g. PXG(n−1) to PXG(n+1)) are illuminated two at a time (as shown by G with hatching lines). To make bright spots even, each of the green pixels (e.g. PXG(n−1) to PXG(n+1)) may be misaligned with the adjacent red pixels (e.g. PXR(n) to PXR(n+1)) and the adjacent blue pixels (e.g. PXB(n) to PXB(n+1)) along the second direction D2. In other words, along the second direction D2, each of the green pixels (e.g. PXG(n−1) to PXG(n+1)) may correspond to two red pixels (e.g. PXR(n) to PXR(n+1)) and two blue pixels (e.g. PXB(n) to PXB(n+1)).

Figure 4:
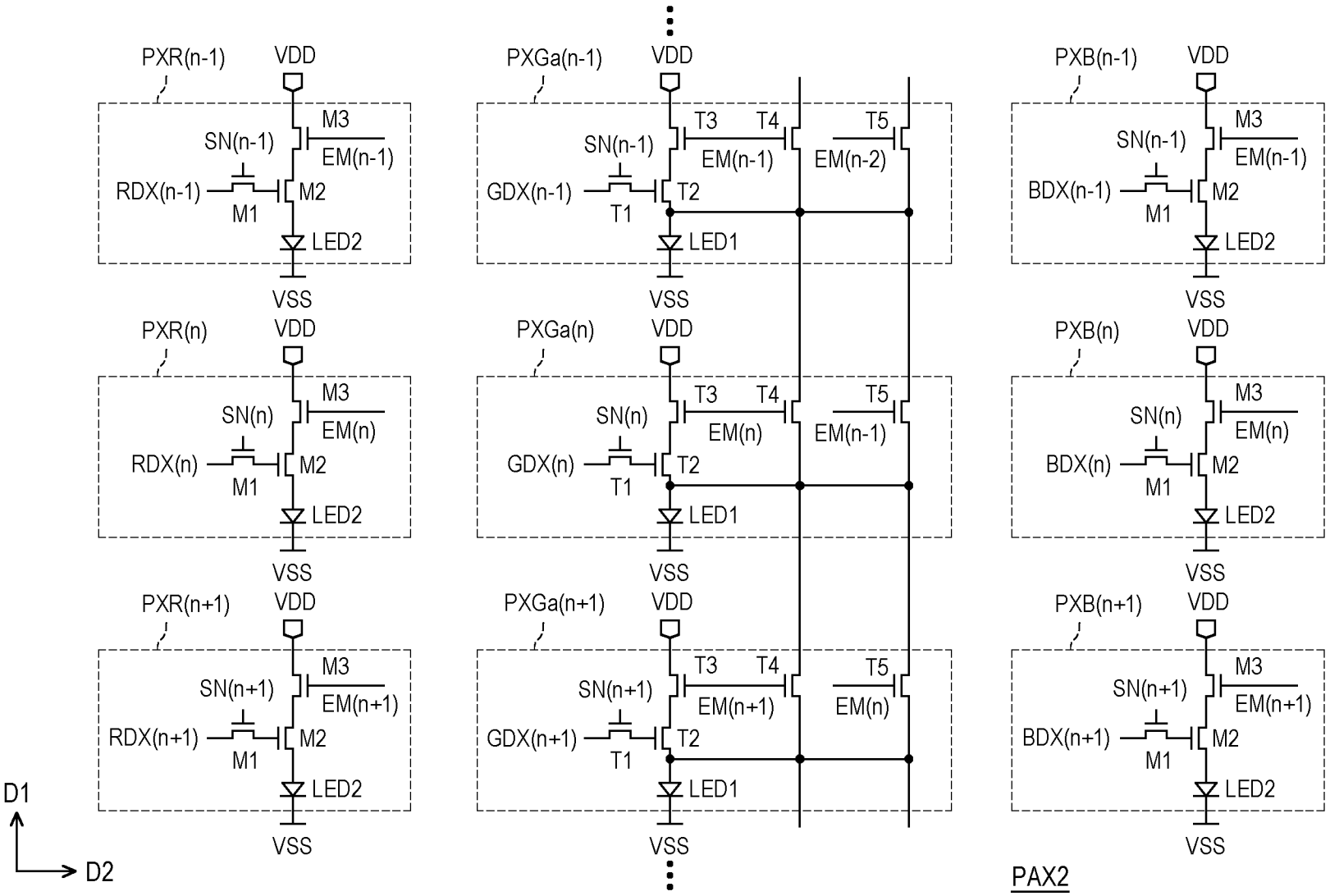
FIG. 4 is a schematic diagram of a circuit of a pixel array according to a second embodiment of the disclosure.

FIG. 4 is a schematic diagram of a circuit of a pixel array according to a second embodiment of the disclosure. Referring to FIG. 1 and FIG. 3, a pixel array PAX2 is similar to the pixel array PAX1. The difference is that each of green pixels (e.g. PXGa(n−1) to PXGa(n+1)) of the pixel array PAX2 further includes a fifth transistor T5. An identical or a similar reference numeral is adopted for an identical or a similar element. The fifth transistor T5 has a first end coupled to the anode of the light-emitting diode LED1 of a vertically adjacent green pixel (e.g. PXGa(n−1) to PXGa (n+1)), a control terminal receiving a second control signal (e.g. light-emitting signals EM(n−2) to the EM(n)), and a second end coupled to the anode of the light-emitting diode LED1.

Specifically, taking the green pixel PXGa(n) as an example, the first end of the first transistor T1 receives the green data signal GDX(n), and the control terminal of the first transistor T1 receives the scan signal SN(n). The control terminal of the third transistor T3 receives the light-emitting signal EM(n), and the control terminal of the fifth transistor T5 receives the light-emitting signal EM(n−1). Referring to FIG. 2 and FIG. 3, as shown in FIG. 2, for the green pixel PXGa(n), the enabled level period of the light-emitting signal EM(n) is later than the enabled level period of the scan signal SN(n) and the enabled level period of the light-emitting signal EM(n−1).

Referring to FIG. 2 and FIG. 4, for example, in a case where the green pixel PXGa(n) is driven, when the scan signal SN(n) is enabled, the green data signal GDX(n) performs writing. Next, when the light-emitting signal EM(n) is enabled, the third transistor T3 and the fourth transistor T4 of the green pixel PXGa(n) are turned on and the fifth transistor T5 of the green pixel PXGa(n+1) is turned on, and a conductivity degree of the second transistor T2 of the green pixel PXGa(n) reflects the voltage level of the green data signal GDX(n). At this time, starting from the system high voltage VDD, a current passes through the second transistor T2, the third transistor T3, and the light-emitting diode LED1 of the green pixel PXGa(n) and flows to the system low voltage VSS. The current also passes through the second transistor T2, the third transistor T3, and the fourth transistor T4 of the green pixel PXGa(n), and the light-emitting diode LED1 of the pixel PXGa(n−1) and flows to the system low voltage VSS. In addition, the current further passes through the second transistor T2 and the third transistor T3 of the green pixel PXGa(n) and the fifth transistor T5 and the light-emitting diode LED1 of the pixel PXGa(n+1) and flows to the system low voltage VSS.

In other words, the second transistor T2, the third transistor T3, and the fourth transistor T4 of the green pixel PXGa(n) and the fifth transistor T5 of the green pixel PXGa(n+1) that are turned on are connected in parallel to the three light-emitting diodes LED1 of the green pixels PXGa (n−1) to PXGa(n+1). Hence, a current passing through each of the green light-emitting diodes may be reduced so that the light-emitting efficiency of the green light-emitting diodes may approach the greatest light-emitting efficiency.

Figure 5:
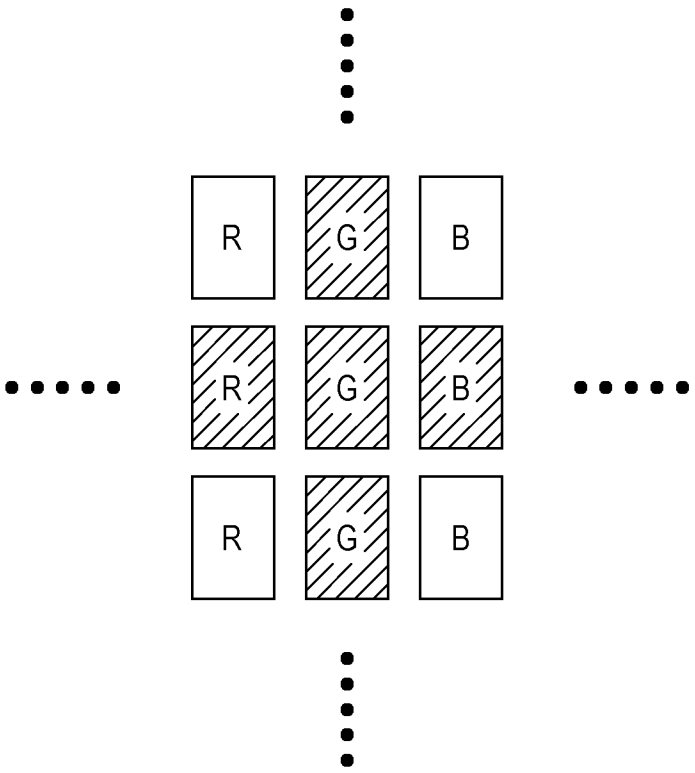
FIG. 5 is a schematic diagram of a display of a pixel array according to a second embodiment of the disclosure.

FIG. 5 is a schematic diagram of a display of a pixel array according to a second embodiment of the disclosure. Referring to FIG. 2, FIG. 4, and FIG. 5, in the embodiment, the red pixels (e.g. PXR(n) to PXR(n+1)) and the blue pixels (e.g. PXB(n) to PXB(n+1)) are illuminated one by one (as shown by R and B with hatching lines). However, the green pixels (e.g. PXGa(n−1) to PXGa(n+1)) are illuminated three at a time (as shown by G with hatching lines). To make bright spots even, each of the green pixels (e.g. PXGa(n−1) to PXGa(n+1)) may be aligned with the adjacent red pixels (e.g. PXR(n) to PXR(n+1)) and the adjacent blue pixels (e.g. PXB(n) to PXB(n+1)) along the second direction D2.

Figure 6:
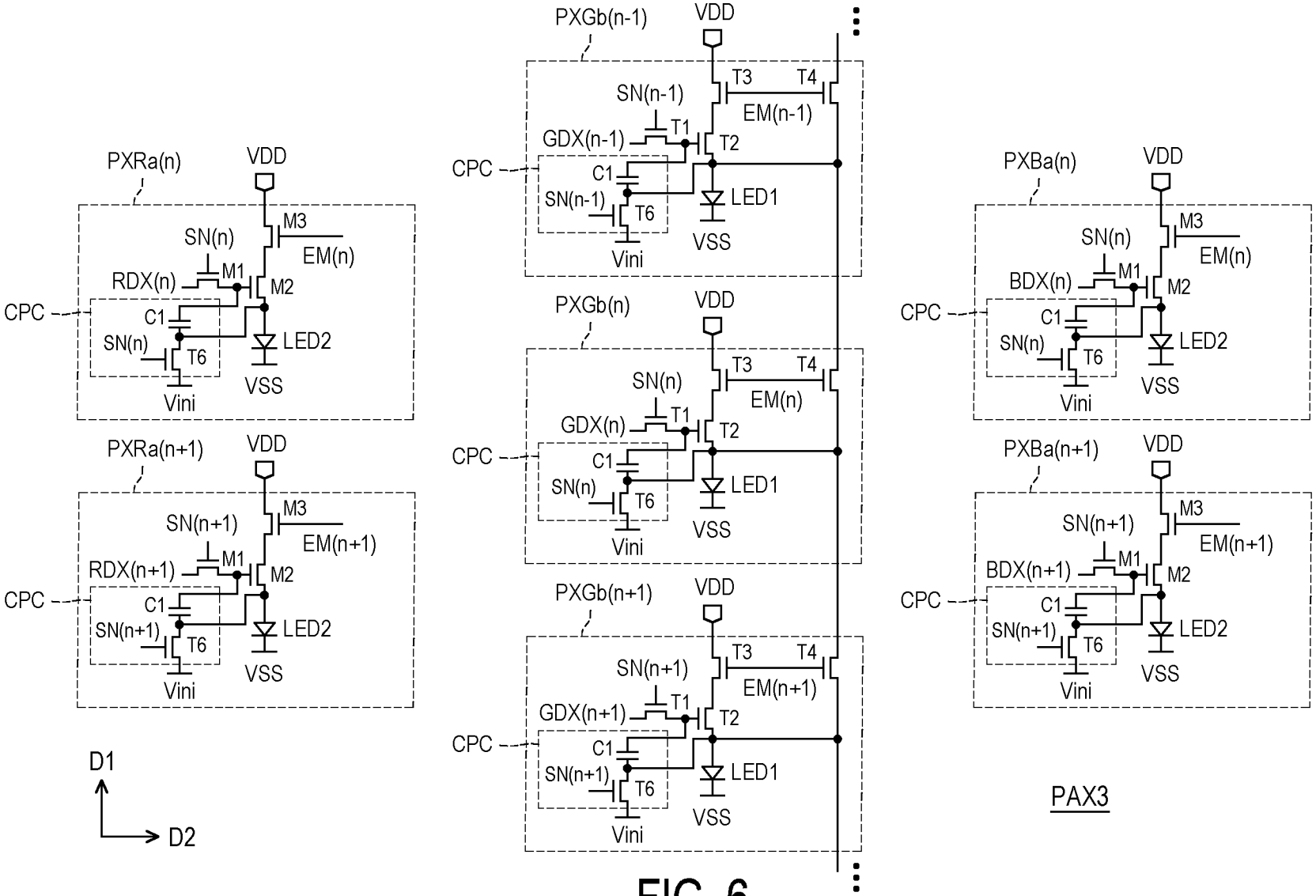
FIG. 6 is a schematic diagram of a circuit of a pixel array according to a third embodiment of the disclosure.

FIG. 6 is a schematic diagram of a circuit of a pixel array according to a third embodiment of the disclosure. Referring to FIG. 1 and FIG. 4, a pixel array PAX3 is similar to the pixel array PAX1. The difference is that each red pixel (e.g. PXRa(n) to PXRa(n+1)), each green pixel (e.g. PXGb(n−1) to PXGb(n+1)), and each blue pixel (e.g. PXBa(n) to PXBa (n+1)) of the pixel array PAX3 further include a compensation circuit CPC. An identical or a similar reference numeral is adopted for an identical or a similar element. In the embodiment, the compensation circuit CPC of each of the green pixels (e.g. PXGb(n−1) to PXGb(n+1)) is coupled to the control terminal and the second end of the second transistor T2 to compensate for a critical voltage of the second transistor T2. The compensation circuit CPC of each of the red pixels (e.g. PXRa(n) to PXRa(n+1)) and the compensation circuit CPC of each of the blue pixels (e.g. PXBa(n) to PXBa(n+1)) are coupled to the control terminal and the second end of the transistor M2 to compensate for a critical voltage of the transistor M2.

In the embodiment, taking the compensation circuit CPC of each of the green pixels (e.g. PXGb(n−1) to PXGb(n+1)) as an example, the compensation circuit CPC includes a first capacitor C1 and a sixth transistor T6. The first capacitor C1 is coupled between the control terminal and the second end of the second transistor T2. The sixth transistor T6 has a first end coupled to the second end of the second transistor T2, a control terminal receiving the scan signal (e.g. SN(n−1) to SN(n+1)), and a second end receiving an initializing voltage Vini. The initializing voltage Vini may be set according to the critical voltage of the second transistor T2 (or the transistor M2) to compensate for the critical voltage of the second transistor T2 (or the transistor M2).

Figure 7:
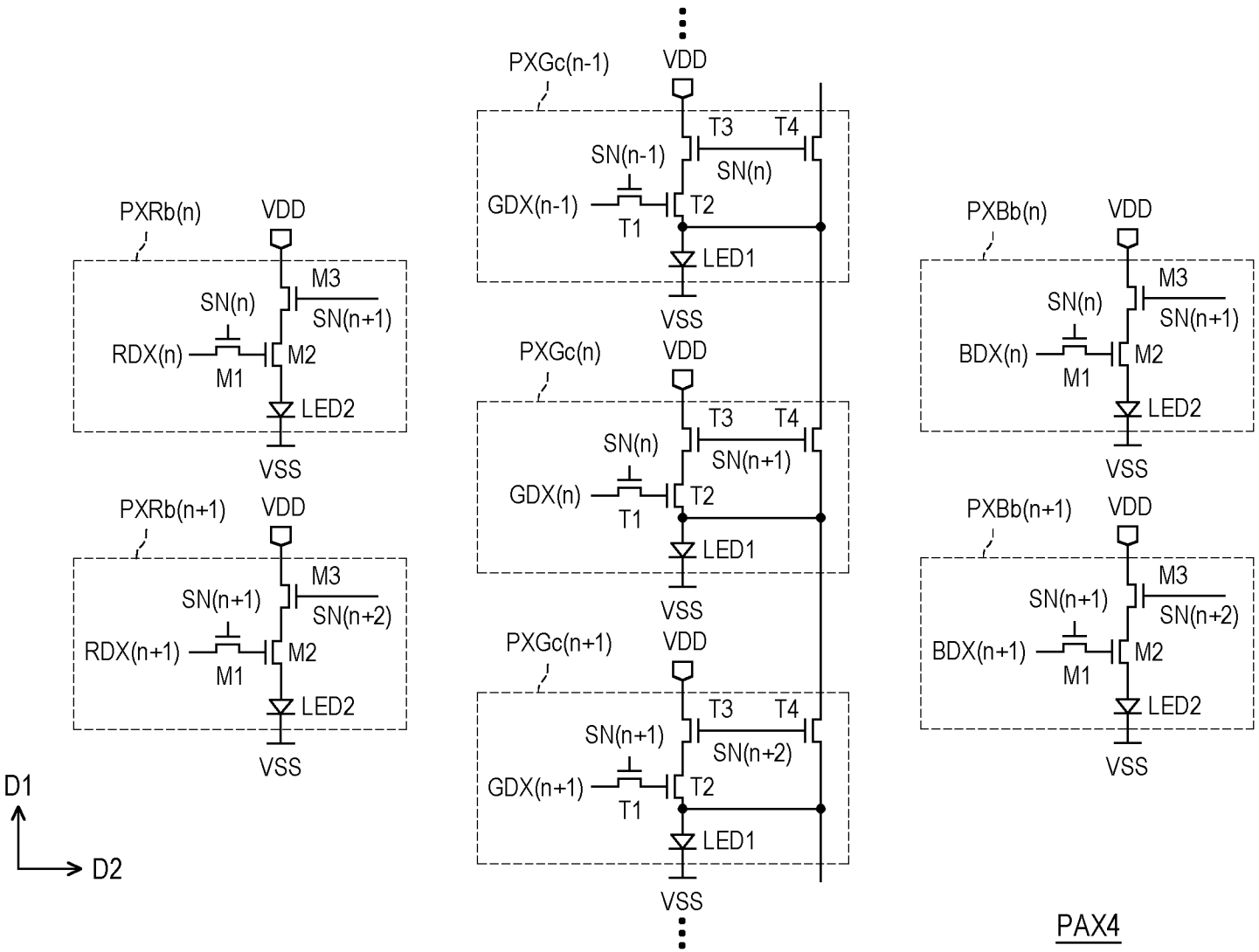
FIG. 7 is a schematic diagram of a circuit of a pixel array according to a fourth embodiment of the disclosure.

FIG. 7 is a schematic diagram of a circuit of a pixel array according to a fourth embodiment of the disclosure. Referring to FIG. 1 and FIG. 7, a pixel array PAX4 is similar to the pixel array PAX1. The difference lies in red pixels (e.g. PXRb(n) to PXRb(n+1)), green pixels (e.g. PXGc(n−1) to PXGc(n+1)), and blue pixels (e.g. PXBb(n) to PXBb(n+1)) of the pixel array PAX4. An identical or a similar reference numeral is adopted for an identical or a similar element.

As shown in FIG. 2, a waveform of the light-emitting signal EM(n−1) is substantially the same as a waveform of the scan signal SN(n). A waveform of the light-emitting signal EM(n) is substantially the same as a waveform of the scan signal SN(n+1). That is, the light-emitting signals EM(n−1) to EM(n+1) may be substantially replaced with the scan signals SN(n) to SN(n+2). Taking the green pixel PXGc(n) as an example, the first end of the first transistor T1 receives the green data signal GDX(n), and the control terminal of the first transistor T1 receives the scan signal SN(n). The control terminal of the third transistor T3 receives the scan signal SN(n+1).

Similarly, the pixel array PAX2 may only adopt the scan signals (e.g. SN(n) to SN(n+2)). Referring to FIG. 4, taking the green pixel PXGa(n) as an example, the first end of the first transistor T1 receives the green data signal GDX(n), and the control terminal of the first transistor T1 receives the scan signal SN(n). The light-emitting signal EM(n) received by the control terminal of the third transistor T3 may be replaced with the scan signal SN(n+1), and the light-emitting signal EM(n−1) received by the control terminal of the fifth transistor T5 may be replaced with the scan signal SN(n).

In summary of the above, in the pixel array of the embodiment of the disclosure, the second transistor, the third transistor, and the fourth transistor are turned on and connected in parallel to the green light-emitting diodes of the green pixels of the current stage and the previous stage, thereby reducing the current passing through each of the green light-emitting diodes. In addition, the second transistor, the third transistor, and the fourth transistor of the current stage and the fifth transistor of the next stage are turned on and connected in parallel to the green light-emitting diodes of the green pixels of the current stage, the previous stage, and the next stage, thereby further reducing the current passing through each of the green light-emitting diodes. In this way, the light-emitting efficiency of the green light-emitting diode may approach the greatest light-emitting efficiency.

Although the disclosure has been described with reference to the above embodiments, they are not intended to limit the disclosure. It will be apparent to one of ordinary skill in the art that modifications to the described embodiments may be made without departing from the spirit and the scope of the disclosure. Accordingly, the scope of the disclosure will be defined by the attached claims and their equivalents and not by the above detailed descriptions.

What is claimed is:

1. A pixel array, comprising:

a plurality of red pixels, a plurality of green pixels, and a plurality of blue pixels, wherein the green pixels are arranged along a first direction to form a plurality of green pixel lines, wherein each of the green pixels comprises:

a light-emitting diode having an anode and a cathode receiving a system low voltage;

a first transistor having a first end receiving a first data signal, a control terminal receiving a first scan signal, and a second end;

a second transistor having a first end, a control terminal coupled to the second end of the first transistor, and a second end coupled to the anode of the light-emitting diode;

a third transistor having a first end receiving a system high voltage, a control terminal receiving a first control signal, and a second end coupled to the first end of the second transistor;

a fourth transistor having a first end coupled to the anode of the light-emitting diode of an adjacent green pixel, a control terminal coupled to the control terminal of the third transistor, and a second end coupled to the anode of the light-emitting diode.

2. The pixel array according to claim 1, wherein the first control signal is a first light-emitting signal, wherein an enabled level period of the first light-emitting signal is later than an enabled level period of the first scan signal.

3. The pixel array according to claim 1, wherein the first control signal is a second scan signal, wherein an enabled level period of the second scan signal is later than an enabled level period of the first scan signal.

4. The pixel array according to claim 1, wherein each of the pixels further comprises:

a fifth transistor having a first end coupled to the anode of the light-emitting diode of the adjacent green pixel, a control terminal receiving a second control signal, and a second end coupled to the anode of the light-emitting diode.

5. The pixel array according to claim 4, wherein the first control signal is a first light-emitting signal, the second control signal is a second light-emitting signal, wherein an enabled level period of the first light-emitting signal is later than an enabled level period of the first scan signal and an enabled level period of the second light-emitting signal.

6. The pixel array according to claim 4, wherein the first control signal is a second scan signal, the second control signal is the first scan signal, wherein an enabled level period of the second scan signal is later than an enabled level period of the first scan signal.

7. The pixel array according to claim 1, wherein each of the green pixels further comprises a compensation circuit coupled to the control terminal of the second transistor and the second end of the second transistor.

8. The pixel array according to claim 7, wherein the compensation circuit comprises:

a first capacitor coupled between the control terminal of the second transistor and the second end of the second transistor;

a sixth transistor having a first end coupled to the second end of the second transistor, a control terminal receiving the first scan signal, and a second end receiving an initializing voltage.

9. The pixel array according to claim 1, wherein the red pixels are arranged along the first direction to form a plurality of red pixel lines, and the blue pixels are arranged along the first direction to form a plurality of blue pixel lines, wherein the red pixel lines, the green pixel lines, and the blue pixel lines are disposed alternately along a second direction perpendicular to the first direction.

10. The pixel array according to claim 9, wherein each of the green pixels is misaligned with an adjacent red pixel and an adjacent blue pixel along the second direction.

11. The pixel array according to claim 9, wherein each of the green pixels is aligned with an adjacent red pixel and an adjacent blue pixel along the second direction.

* * * * *